United States Patent [19]

Green et al.

[11] Patent Number: 5,052,412

[45] Date of Patent: Oct. 1, 1991

[54] MAKING OF SMOKING ARTICLES

[75] Inventors: John D. Green, Hampshire; Philip J. Kinnard, Southampton, both of Great Britain

[73] Assignee: British-American Tobacco Company Limited, London, England

[21] Appl. No.: 62,361

[22] Filed: Jun. 12, 1987

Related U.S. Application Data

[63] Continuation of Ser. No. 435,902, Oct. 22, 1982, abandoned.

[30] Foreign Application Priority Data

Oct. 20, 1981 [GB] United Kingdom ..... 8132620[U]

[51] Int. Cl.[5] ..... A24C 5/14; A24C 5/18; A24C 5/28

[52] U.S. Cl. ..... 131/31; 131/62; 131/79; 131/84.1

[58] Field of Search ..... 131/84.1, 31, 62–64, 131/79, 300, 309, 310, 362

[56] References Cited

U.S. PATENT DOCUMENTS

| | | | |
|---|---|---|---|
| 2,149,896 | 3/1939 | McArdle et al. | 131/362 |
| 2,543,277 | 2/1951 | Copeman | 131/63 |
| 3,817,258 | 6/1974 | Ernow | 131/31 |
| 4,286,605 | 9/1981 | Goslin et al. | 131/31 |
| 4,434,804 | 3/1984 | Bolt et al. | 131/310 |

FOREIGN PATENT DOCUMENTS

| | | | |
|---|---|---|---|
| 2078487 | 1/1982 | United Kingdom | 131/84 R |

*Primary Examiner*—V. Millin

*Attorney, Agent, or Firm*—Kane, Dalsimer, Sullivan, Kurucz, Levy, Eisele and Richard

[57] ABSTRACT

In a method of making lengths of smoking-material rod, particularly cigarette lengths, smoking material and wrapper-web material are each continuously fed to a rod maker operable to wrap and seam-seal the wrapper material about the smoking material to provide smoking material rod which is then fed to a cutter for cutting the rod into lengths. Smoke-modifying agent is applied by spray intermittently to one of the materials during their feeding to the rod maker so that, in each of the lengths, the smoke-modifying agent is distributed over one end zone which is accounted for by a few puffs, in the smoking of the length. The smoke modifying agent is of low volatility and low porosity migration.

10 Claims, 1 Drawing Sheet

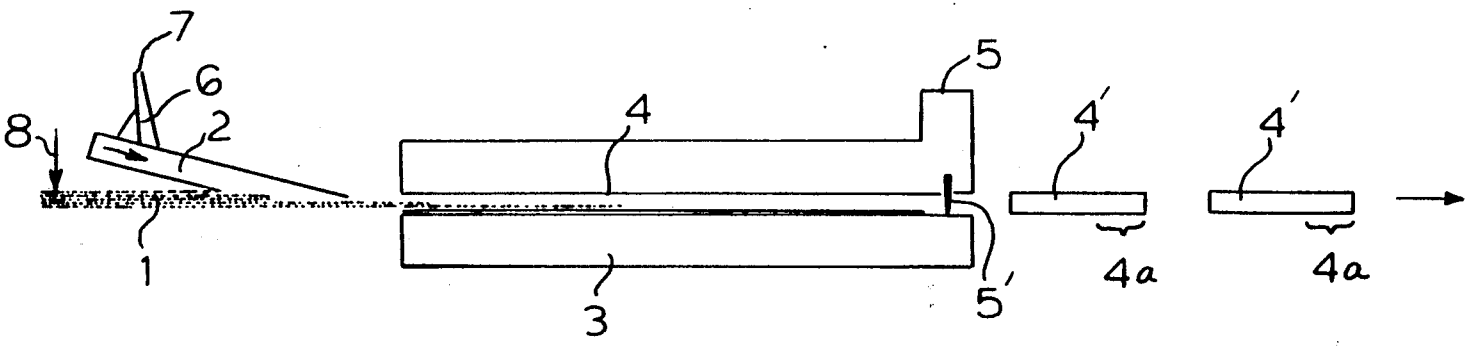
8
7
6
2
1
4
3
5
5'
4'
4a
4'
4a

MAKING OF SMOKING ARTICLES

This is a continuation of co-pending application Ser. No. 435,902 filed on Oct. 22, 1982, now abandoned.

This invention relates to the making of smoking articles incorporating smoke-modifying agents.

BRIEF DESCRIPTION OF THE PRIOR ART

It is well known to incorporate smoke-modifying agents in cigarettes and other smoking articles. Smoke-modifying agents include materials acting to impart a desired flavour or aroma to the mainstream and/or side-stream smoke of a cigarette, and physiologically active agents or smoke-body enhancing agents acting to modify the smoker's perception of the quality of mainstream smoke.

It is an established practice in incorporating a smoke-modifying agent in the tobacco rods of cigarettes to apply the agent to the tobacco in such manner that the agent is substantially uniformly distributed along the full length of the tobacco rod. Advantages can, however, be obtained from an asymmetric distribution of a smoke-modifying agent. Asymmetric smoke-modifying agent distributions are described in United Kingdom Patent No. 2 078 487A. That Patent proposed methods for introducing smoke-modifying agents into filter tipped cigarettes subsequent to the manufacture thereof. These methods rely upon the entrainment of particles of smoke-modifying agent in a stream of air induced to flow through each cigarette.

It is an object of the present invention to provide a practical method by which lengths of smoking material rod, cigarette rods for example, can be obtained having an asymmetric distribution of smoke-modifying agent, the method being consistent with and involving minimal departure from current high-speed rod-making technology. It is a further object of the invention to provide a method by the use of which there can be obtained uniform loadings of smoke-modifying agent from rod length to rod length.

SUMMARY OF THE INVENTION

The present invention provides a method of making lengths of smoking material rod, wherein smoking material and wrapper-web material are each continuously fed to a rod maker operable to wrap and seam seal said wrapper-web material about said smoking material to provide a smoking-material rod, said rod being fed to a cutter operable to cut the rod into uniform lengths, particularly cigarette lengths, and smoke-modifying agent is so applied intermittently to one of said materials during the feeding thereof to said rod maker that, in each of the lengths of rod, said smoke-modifying agent is distributed over one end zone, which zone is accounted for by a few puffs, particularly a first few puffs, in the smoking of the rod length.

The same or a different smoke-modifying agent may be applied to the other of the materials during the feeding thereof to the rod maker.

Advantageously, the zone extends from one end of the length of smoking-material rod for a distance therealong accounted for by from two puffs to half the total number of puffs as measured when the rod length is machine smoked under standard conditions of 35 cc puffs of 2 seconds duration at one minute intervals. In percentage terms, the zone of distribution of the smoke-modifying agent may occupy from 15%, preferably at least 25%, to 50% of the rod length.

In the portion of the length of smoking-material rod outside of the aforementioned zone there may be distributed another smoke-modifying agent. The latter may be of a different agent or of the same agent at a significantly lower application level than in the said zone.

BRIEF DESCRIPTION OF THE DRAWING

The accompanying drawing is a diagrammatic illustration of a preferred embodiment method of the invention.

DETAILED DESCRIPTION OF THE PREFERRED EMBODIMENTS OF THE INVENTION

The present invention provides a method of making lengths of smoking material rod, in which, in the embodiment illustrated by way of example in the accompanying diagrammatic drawing, in smoking material 1, for example tobacco in well known shred form, and wrapper-web material 2, for example paper, are each continuously fed to a rod maker 3 comprising a garniture operable in known manner to wrap and seam-seal said wrapper-web material 2 about said smoking material 1 to provide smoking-material rod 4, said rod being fed to a known cutter device 5 operable to cut the rod 4 at 5' into uniform lengths 4', particularly cigaret lengths. Liquid smoke-modifying agent 6 is so applied intermittently to one of said materials as illustrated to the wrapper web 2, by a spray device 7 during the feeding thereof to said rod maker 3 that, in each of the rod lengths 4', said smoke-modifying agent is distributed over one end zone **4*a***, which zone is accounted for by a few puffs, particularly a first few puffs, in the smoking of the rod length.

The same or a different smoke-modifying agent may be applied to the other of the materials for example at 8, during the feeding thereof to the rod maker 3.

Advantageously, the aforesaid zone **4*a* extends from one end of the length of smoking-material rod 4'** for a distance therealong accounted for by from two puffs to half the total number of puffs as measured when the rod length is machine smoked under standard conditions of 35 cc puffs of 2 seconds duration at one minute intervals. In percentage terms, the zone of distribution of the smoke-modifying agent may occupy from 15%, preferably at least 25% to 50% of the rod length.

There currently exists an interest in low-delivery cigarettes, that is to say cigarettes which, during smoking, give low mainstream-smoke deliveries of specified smoke constituents, tar and nicotine for example. However, it has been observed that, in some cases, smokers of low-delivery cigarettes have registered some lack of satisfaction, in regard to flavour for example, during the first few puffs. Cigarettes may be provided by use of the present invention which meet this problem if a smoke-modifying agent, for instance a tobacco-flavour enhancer, is incorporated in a low-delivery cigarette over a portion of the length thereof accounted for by the first few puffs, the first three to five puffs say. The application level of the agent over this portion may be the same as that which would be adopted in accordance with the prior orthodox practice for distribution of the agent over the full length of the tobacco rod. Alternatively, it may be arranged that the quantity of agent applied to the portion in question of the tobacco rod might be approximately equivalent to that which would have been applied over the full length of the rod, or an application level may be selected between or in excess of these values.

It is common practice to incorporate a filter in cigarettes for the purpose of removing constituents of the mainstream smoke. Currently the preponderance of filters embody a plug formed of cellulose acetate fibres. Although cellulose acetate possesses a number of merits as a filtration material, it has a disadvantage when incorporated in filters of cigarettes the tobacco rods of which have been treated with a smoke-modifying agent distributed along the full length of the tobacco rod. This is because cellulose acetate preferentially attracts some agents when they are incorporated in the tobacco rod in a manner such that they are free to migrate. Migration of a smoke-modifying agent to a cellulose acetate filter results in a reduction of the delivery of the agent when the cigarette is subsequently smoked because the agent does not, in most cases, transfer from the cellulose acetate to the smoke as readily as it does from the tobacco to the smoke. By use of the present invention, there may be provided improved filter cigarettes the tobacco rods of which incorporate a free-to-migrate smoke-modifying agent, since if the agent is applied to the rod at a zone thereof in the region of the end remote from the filter, the agent has less opportunity of migrating to the filter during storage subsequent to cigarette manufacture. Thus, if a given quantity of smoke-modifying agent is applied at a forward end zone of the rod, instead of in accordance with prior practice, a significantly higher proportion of the agent will be available to fulfil the object for which it is used.

Cigarettes are known which are judged by some smokers thereof to produce in the last few puffs a mainstream smoke which is perceived to be of a harsh nature. Cigarettes may be provided by use of the present invention which embody a smoke-modifying agent in a portion thereof accounting for the last few puffs, the agents being selected to provide a smoothing effect counteracting the harshness of the mainstream smoke.

In cigarettes and other smoking articles made by the method in accordance with the present invention, the smoking material may be selected from one or more of cut tobacco, reconstituted tobacco and tobacco substitute material.

If, in accordance with the present invention, a smoke-modifying agent is to be applied to tobacco and/or to cigarette paper just before the entry thereof into a rod-making garniture of a cigarette making machine, the agent, dissolved in a suitable volatile vehicle, may be sprayed by use of an intermittently operating spray device. Such device could be a spray device similar to that described in United Kingdom Patent No. 1 357 057. The device according to that specification may be arranged to spray a liquid containing an aromatic substance onto a layer of tobacco at a location close to the entry of a cigarette-maker garniture to which the tobacco is fed. In order to serve for the purpose of the present invention, the spray device would have to be modified so as to operate intermittently in correct phase with the rod cutter of the cigarette maker. As disclosed in Patent No. 1357057, liquid is supplied to a spray nozzle by means of pressurized air. Modification of the spray device to adapt it for present purposes could comprise, for example, replacement of the pressurized-air system by a pump operable to deliver predetermined quantities of liquid additive to the nozzle.

If smoke-modifying agent is to be applied to rod wrapper, it may, as an alternative to being sprayed onto the wrapper web, be applied thereto by means of a continuously rotating rotary applicator operable to transfer the agent to the web from one or more portions of its periphery.

The preferred smoke-modifying agents suitable for use in the method according to the invention inherently have, or have imparted to them, a limited propensity for migration. Thus if an agent is to be applied directly to the smoking material rod it should be of low volatility at ambient temperatures. A class of substantially non-volatile compounds is known which if applied to tobacco, release to the smoke thereof volatile smoke-modifying agents when the tobacco is burned. Members of this class may be selected for use according to the present invention. They include polymers with pendent flavour molecules. They also include glycosides in which the alglycone is a flavourant material such as menthol, eugenol, $\beta$ phenylethanol or benzylalcohol. Use may also be conveniently made of micro-encapsulated agents whether included in the smoking material or applied to the wrapper web.

There follows a description of a laboratory experiment which illustrates advantages to be obtained from asymmetric distribution of a smoke-modifying agent in cigarettes.

Filter tipped cigarettes were selected having a 64 mm long rod of cut flue-cured tobacco enwrapped in cigarette paper of an air permeability of 120 Coresta units. The filters were of cellulose acetate and were unventilated. These cigarettes when machine smoked under standard conditions had an average puff number of 8.4.

A flavourant compound, coumarin, which was in radiolabelled form for analytical purposes, was dissolved in ethanol at a concentration level of 309 $\mu$g $cm^{-3}$. The cigarettes were divided into three groups (A, B and C) and equal quantities, each of 10 $\mu$l, of the coumarin solution were introduced into the tobacco rod of each of the cigarettes by means of a syringe. In the cigarettes of Group A the coumarin solution was deposited substantially uniformly along the full length of each tobacco rod. In Group B the coumarin solution was deposited over the forward three-eighths of each tobacco rod, whereas in Group C it was deposited over the rearward three-eighths of each rod adjacent to the filter.

After injection, the cigarettes were stored for twenty-four hours. They were then machine-smoked under standard conditions until the coal had reached the mid-point of the tobacco rod, at which time they were extinguished by contact with crushed solid carbon dioxide. During the smoking period mainstream total particulate matter (TPM) was collected on Cambridge filter pads and the mainstream vapour phase components were collected using cooled ethanol contained in a glass-ball filled bubble trap.

The Cambridge filter pads, the remaining halves of the tobacco rods and the filters were individually subjected to ethanolic extraction using measured amounts of ethanol. Liquid scintillation techniques were then used to count the radioactivity content of each of the ethanolic extracts and of solution from the bubble trap. By this means a determination was made of the coumarin distribution on a percentage basis after smoking. The results are given in the table below.

| | Coumarin, Percentage Distribution | | | |
|---|---|---|---|---|
| Group | Tobacco | Filter | Mainstream Smoke | Sidestream Smoke |
| A | 46.1 | 6.3 | 7.8 | 39.8 |
| B | 4.5 | 8.1 | 10.6 | 76.8 |
| C | 88.5 | 3.2 | 2.3 | 6.0 |

The value for the percentage of the coumarin in the sidestream smoke was calculated on the basis that all coumarin not accounted for in the tobacco, filter and mainstream smoke would be in the sidestream smoke. Inasmuch as a small proportion of the coumarin introduced into the cigarettes may have been lost by migration during the storage period preceding the smoking, these sidestream values are possibly slightly in excess of the actual values. The results do though clearly show that the coumarin distributions after the smoking of half the tobacco rod, i.e. after about 4 puffs, is very different for the three groups of cigarettes. It can be seen, for example, that by distributing a quantity of coumarin over the forward half of the tobacco rod rather than over the full length thereof, the proportion of the coumarin entering the mainstream smoke during the smoking of the forward half of the rod is increased by 36%, whereas that entering the sidestream smoke increases by 93%.

What is claimed is:

1. A method of making lengths of smoking-material rod wherein smoking material and wrapper-web material are each continuously fed to a rod maker, the web material is wrapped and seam-sealed about said smoking material to provide smoking-material rod, which is cut into uniform lengths, and liquid smoke-modifying agent is applied intermittently in synchronized relationship with said cutter to said smoking material and said wrapper web material during their feeding to the garniture of the rod maker so that, in each of the said lengths, the said agent is distributed over one end zone only, which zone is accounted for by a few puffs in the smoking of the rod length.

2. A method of making cigarettes, wherein cigarette-tobacco material and wrapper-web material are each continuously fed to a rod maker operable to wrap and seam-seal said web material about said tobacco material to form cigarette rod which is cut into cigarette lengths and liquid smoke-modifying agent is applied intermittently in synchronous relationship with the cutter to said smoking material and/or said wrapper webs during their feeding to the garniture of said rod maker so that, in each of the said lengths, the smoke-modifying agent is distributed over one end zone only, which zone is accounted for by a few puffs in the smoking of the said length.

3. A method according to claim 2 wherein a cigarette rod length and a filter element are interattached by a tipping material.

4. A method according to claim 3 wherein the zone in which smoke-modifying agent is provided is remote from said filter.

5. A method according to claims 2 or 3 wherein the smoke-modifying agent is of low volatility and low propensity for migration.

6. A method according to claims 1, 2 or 3 whereinsaid smoke-modifying agent is applied to said tobacco by intermittent spray means.

7. A method according to claim 1, 2 or 3, wherein the smoke-modifying agent is distributed over not less than 25% of each said length.

8. A method according to the claim 1, 2 or 3, wherein the smoke-modifying agent is distributed, in each said length, over a zone accounting for a first few puffs only in the smoking of the said length.

9. A method according to claim 2 or 3, wherein further smoke-modifying agent is distributed over a portion of the rod which is outside the said zone.

10. A method according to claim 2 or 3 as applied to low-delivery cigarettes, wherein the liquid smoke-modifying agent is a tobacco-flavour enhancing agent distributed over the said end zone.

* * * * *

UNITED STATES PATENT AND TRADEMARK OFFICE
CERTIFICATE OF CORRECTION

PATENT NO. : 5,052,412

DATED : October 1, 1991

INVENTOR(S) : John D. Green and Philip J. Kinnard

It is certified that error appears in the above-identified patent and that said Letters Patent is hereby corrected as shown below:

Col. 1; between lines 1 and 2; insert the headings

-- BACKGROUND OF THE INVENTION

Field of the Invention --

Col. 5, line 39; delete the word "to" and insert in its place

-- directly onto --

Col. 5, line 39 bridging line 40; delete the words "and said wrapper"

Col. 5, line 40 bridging line 41; delete the words "material during their feeding to the garniture of the" and insert in their place -- during the feeding of said smoking material to the garniture of the --

Col. 6, lines 10 and 11; delete lines 10 and 11 in their entirety and insert in their place -- said smoking material during the feeding of said smoking material to the garniture of said rod makes so that --

UNITED STATES PATENT AND TRADEMARK OFFICE

CERTIFICATE OF CORRECTION

PATENT NO. : 5,052,412

DATED : October 1, 1991

INVENTOR(S) : John D. Green, et. al.

It is certified that error appears in the above-indentified patent and that said Letters Patent is hereby corrected as shown below:

Col. 6, line 35; after the word "claim" and before the numeral "2" insert -- 1 --.

Signed and Sealed this

Nineteenth Day of July, 1994

*Attest:*

*Attesting Officer*

Bruce Lehman

BRUCE LEHMAN

*Commissioner of Patents and Trademarks*